US005375550A

United States Patent [19]

Innis

[11] Patent Number: 5,375,550

[45] Date of Patent: Dec. 27, 1994

[54] STABILIZED FLOATING PLATFORM ASSEMBLY

[76] Inventor: Donald A. Innis, 1400 Fifth Ave., #400, San Diego, Calif. 92101

[21] Appl. No.: 73,297

[22] Filed: Jun. 3, 1993

Related U.S. Application Data

[63] Continuation of Ser. No. 867,440, Apr. 13, 1992, abandoned.

[51] Int. Cl.[5] ..... B63B 35/44

[52] U.S. Cl. ..... 114/267; 114/266

[58] Field of Search ..... 114/78, 121–123, 114/125, 263–267; 405/195, 200; 212/101, 190

[56] References Cited

U.S. PATENT DOCUMENTS

| | | | |
|---|---|---|---|
| 3,316,871 | 5/1967 | Tucker | 114/121 |
| 3,537,412 | 11/1970 | Henderson | 114/0.5 |
| 3,688,719 | 9/1972 | Amirikian | 114/121 |
| 4,167,147 | 9/1979 | Bergman | 114/122 |
| 4,176,614 | 12/1979 | Goss et al. | 114/125 |
| 4,207,828 | 6/1980 | Horowitz et al. | 114/125 |
| 4,221,504 | 9/1980 | Person | 114/264 |
| 4,231,313 | 11/1980 | Heerema et al. | 114/265 |
| 4,261,277 | 4/1981 | Bergman | 114/125 |
| 4,312,288 | 1/1982 | Finsterwalder | 114/264 |
| 4,366,766 | 1/1983 | Bergman | 114/125 |
| 4,988,317 | 1/1991 | Rubinsak | 114/267 |
| 5,038,702 | 8/1991 | Bowes | 114/265 |

*Primary Examiner*—Douglas C. Butler
*Assistant Examiner*—Clifford T. Bartz
*Attorney, Agent, or Firm*—Brown, Martin, Haller & McClain

[57] ABSTRACT

A large floating platform assembly is assembled from a plurality of identical, relatively small modules each comprising a tubular member which is open at one end and has a flat head at the opposite end. The modules are secured together in a side-by-side arrangement at their headed ends to form a continuous flat platform of the desired area with the tubular members projecting downwardly from the platform into the water to receive water into their lower ends and form trapped pockets of compressed air beneath the entire area of the platform on which the platform is supported. The trapped air chambers may be interconnected to increase stabilization of the platform.

15 Claims, 3 Drawing Sheets

STABILIZED FLOATING PLATFORM ASSEMBLY

This is a continuation of application Ser. No. 07/867,440, filed Apr. 13, 1992, now abandoned.

BACKGROUND OF THE INVENTION

The present invention relates generally to large floating structures and is particularly concerned with floating platforms and the like to provide expanded areas for living accommodations, airports, de-salinization plants, bases for underwater exploratory stations, military bases and the like.

Off-shore floating platforms have been proposed in the past to provide greater area for expanding populations and for airports and other service installations. However, these have all been subject to various disadvantages. One problem with a floating platform is that of stabilization to reduce surface effects and wave motion on the platform. Most have been dependent on raising the platform itself above the water surface. Although this may be practical for small platforms, it is less economical for very large platforms of 360,000 square feet or greater. U.S. Pat. No. 5,038,702 of Bowes describes a small floating structure in which a work platform is supported above the water level on submerged pontoons to which the platform is secured by vertical support columns at the corners of the platform. Some larger scale off-shore platforms are supported on posts embedded in the sea bed, which is a relatively expensive solution and will be subject to high loads.

SUMMARY OF THE INVENTION

It is an object of the present invention to provide a new and improved floating platform.

According to the present invention, a floating platform is provided which comprises a plurality of modules secured together to form an array of predetermined or post-determined area, each module comprising a hollow tube having a flat cap or head at its upper end and being open at its lower end, the modules being secured to adjacent modules in the array to form a continuous flat platform with the tubes projecting downwardly from the platform into the water with their open lower ends open to the water to receive water into the respective lower ends of the tubes and trap air in a trapped air chamber above the water surface in each tube to support the platform. Thus, the platform is supported on a plurality of trapped pockets of air extending across its entire area.

The amount of water entering each tube will be dependent on the load on the platform and the wave motion of the water surface. In a preferred embodiment of the invention, the trapped air chamber in each tube is connected via passageways to all of the adjacent tubes. With this arrangement, any chambers which are under high pressure due to wave motion will transmit air to neighboring chambers under lower pressure, tending to dampen the effects of wave motions or surges across the area of the platform. Control valves may be provided in the connecting passageways in order to adjust the size of the connecting orifice to meet varying sea conditions, in a similar manner to adjustment of a race car's suspension to meet variable track conditions.

The height of the individual modules will be dependent on the platform load requirements, with the modules being taller for higher loads. In a preferred embodiment, each module has four air orifices, one for connection to each adjacent module, with the exception of those modules at the outer periphery of the platform which will have only three air orifices, and two air orifices in the case of the corner modules.

In an alternative embodiment, instead of simple valved connecting passageways between the modules, reversible air turbine generators may be provided in some or all of the passageways between modules for converting the compressed air flow in the passageways to electricity. This allows wave energy to be converted readily to electrical power. Thus, the platform could generate its own energy for use on the facility mounted on the platform, such as an airport, desalinization plant, re-cycling plant or the like or for use for other purposes.

The floating platform will be similar to a large carpet thrown across the sea and supported on multiple, side-by-side pockets of air which essentially act as a monolithic entity. The construction of the platform is relatively simple since it comprises a plurality of identical modules which are simply secured together. The differential forces on the components of the platform will be reduced due to the uniform support extending across the entire platform area, rather than individual, widely spaced supports subject to high differential loads. It can be made at much less expense than a direct displacement structure of equivalent size, and can be made cost effective by utilizing the wave energy of the underlying water surface to create power.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
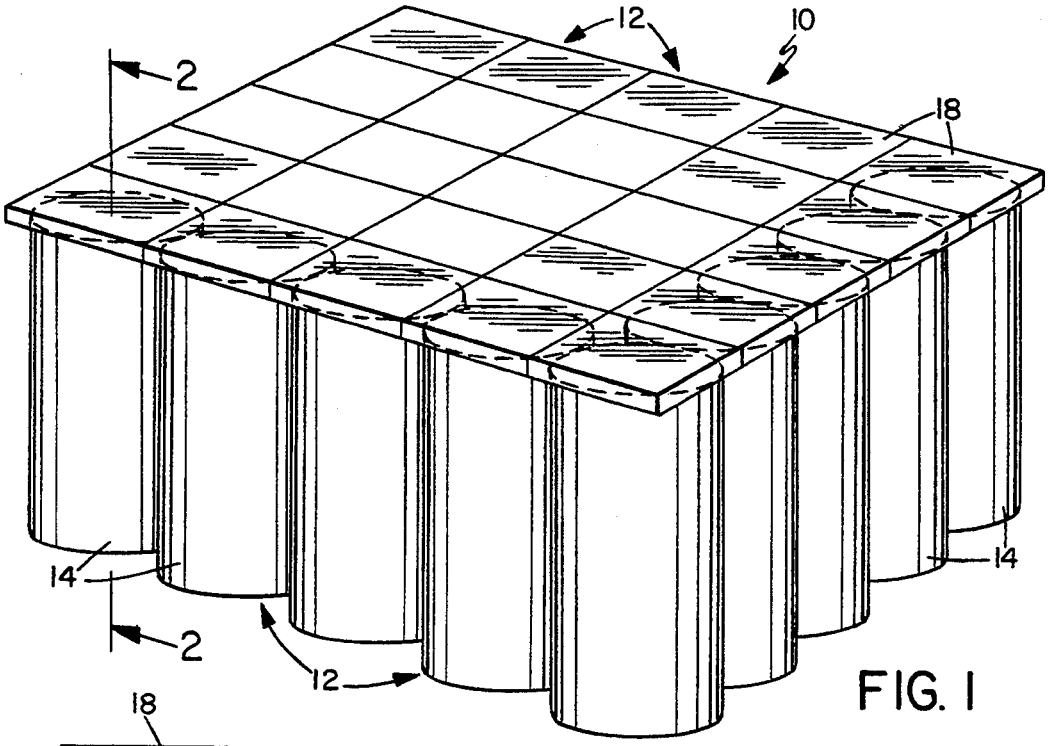
FIG. 1 illustrates a typical assembly of platform modules according to a preferred embodiment of the present invention.
Figure 3:
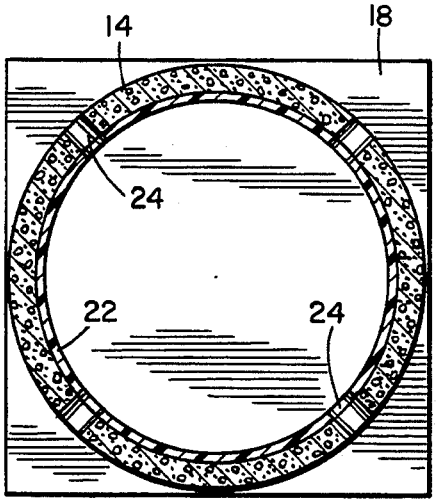
FIG. 3 is a sectional view taken on line 3—3 of FIG. 2.
Figure 4:
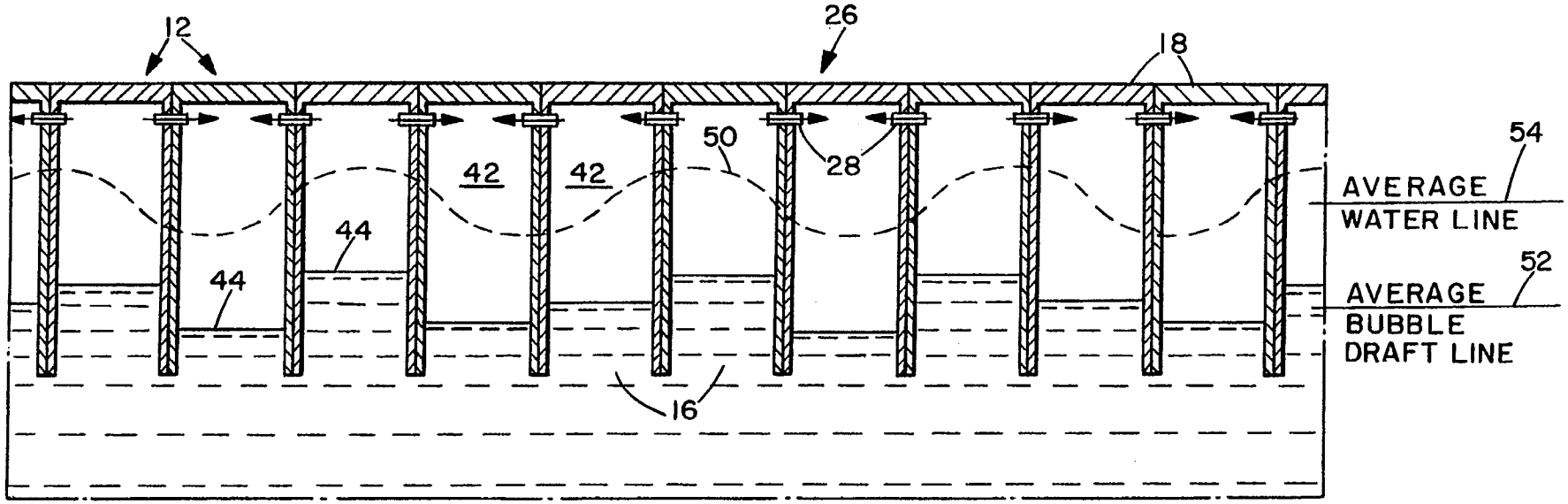
FIG. 4 is a typical cross-section through a platform assembly, showing the operation of the flotation modules in response to wave action.

FIGS. 1 and 4 of the drawings illustrate a floating platform assembly 10 according to a preferred embodiment of the present invention made up of a plurality of individual platform modules 12 arranged in a rectangular array and secured together to form the platform. The modules are identical in structure, and one of the modules 12 is illustrated in more detail in FIGS. 2 and 3.

Figure 2:
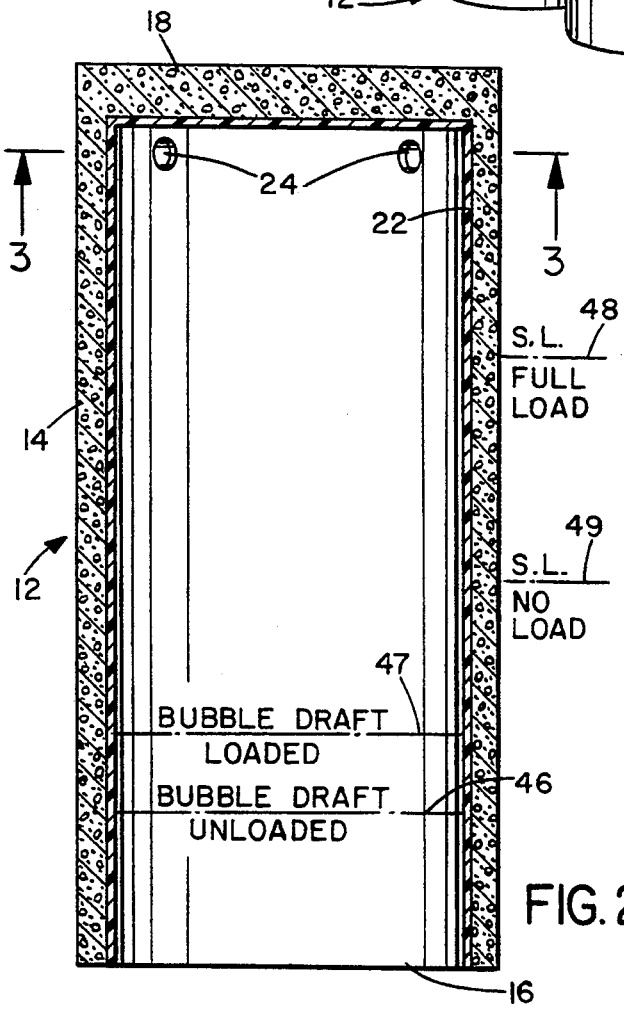
FIG. 2 is an enlarged sectional view taken on line 2—2 of FIG. 1.

As best illustrated in FIGS. 2 and 3, each module 12 comprises a hollow tube or cylinder 14 which is open at its lower end 16 and has a flat head or cap 18 of square shape at its upper end. The cylinder walls are of air-entrained concrete or similar water resistent and durable material, and the cylinder walls are preferably reinforced with post-or pre-tensioned vertical steel tendons and welded circular horizontal tie bars. The internal surfaces of the cylinder and cylinder head may be lined with a layer 22 of reinforced plastic or similar materials.

Figure 5:
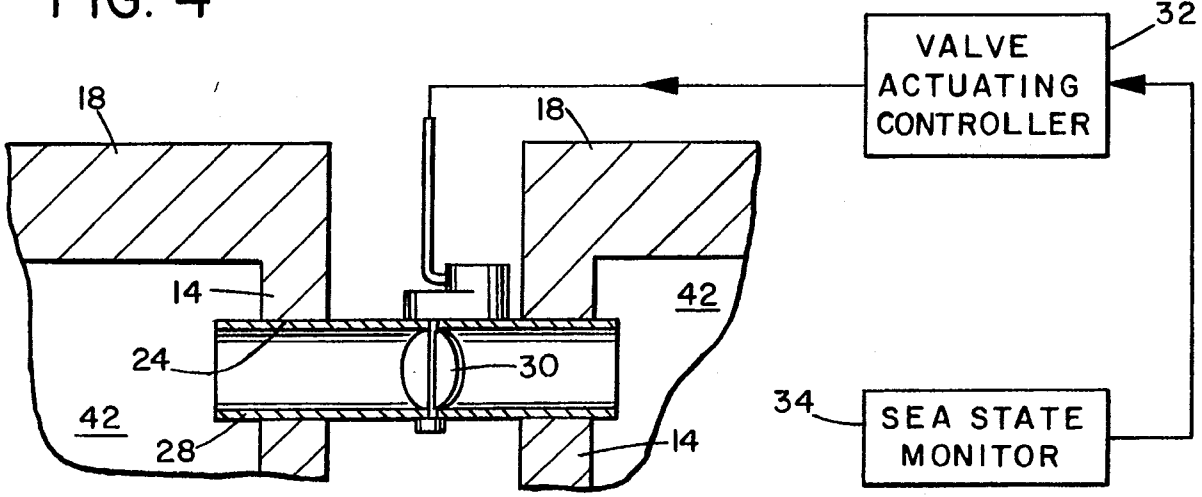
FIG. 5 is an enlargement of a portion of FIG. 4, with detail of a typical chamber interconnecting valve.

The module has four air orifices 24 arranged at right angles to one another. In order to make up a rectangular platform 26 of the desired dimensions, as illustrated in FIGS. 1 and 4, a plurality of modules are arranged in an array covering the desired platform area with the cylinder heads 18 secured together by welding or the like at their adjacent side edges, with the air orifices in each cylinder aligned with one air orifice in each of four directly or diagonally adjacent cylinders. As illustrated schematically in FIG. 4, a connecting air passageway 28 extends between each pair of aligned orifices 24. A valve 30 for controlling the size of the air orifice is preferably provided in each passageway 28, as illustrated in FIG. 5. The passageway preferably extends across a space between the two cylinders in this case, for example in a diagonal interconnection, in order to provide easy access to the valve. A suitable electronic valve actuating controller 32 is provided for controlling each valve 30 based on the output of a sea state monitor 34 mounted on the outside of the platform. In some cases, where the range of sea conditions can be predetermined in order to set the appropriate orifice size, valve 30 may not be needed. The modules at the peripheral edges of the platform will have only three air orifices connected to the three adjacent modules, while the modules at the corners will have only two air orifices for connection to the two adjacent modules. Alternatively, all modules will be made with four orifices and the outer orifices will be suitably plugged after construction of the platform.

In the illustrated arrangement, each module comprises a cylinder with a square head. However, clearly other interfitting shapes may be used in alternative embodiments and the heads may have any shape of polygonal periphery. Clearly, where the sides of the module head have more facets, there will be a greater number of adjacent modules and thus a greater number of connecting passageways.

With this arrangement, a flat platform 26 is formed which can be supported on the water surface on a plurality of pockets of trapped air in each of the cylinders. Water will enter the open lower end of each cylinder to a level dependent on air pressure in trapped air chamber 42 above the water level 44. Considering one cylinder or module as illustrated in FIG. 2, the weight or load on the cylinder head will compress gas or trapped air in chamber 42 until the pressure is high enough to start displacing water from the chamber. When the air reaches a proper pressure for supporting the platform, it will have displaced a volume of water equal in weight to that of the platform. Thus, the water level in the chamber will be dependent on load, and the water level will be higher for higher loads. In FIG. 2, line 46 represents the water line when the module is not loaded and line 47 represents the water line in the module when loaded. Lines 48 and 49 represent the surrounding sea level when the platform is under a full load and when it is unloaded, respectively.

The dimensions of each module will be dependent on the overall platform dimensions as well as the load to be supported. A module designed for a superimposed load of 400 pounds per square foot, for example, may have a height of 40 feet (12.19 meters), a diameter of 20 feet (6.10 meters) with a head or end cap which is 20 foot square. The walls are preferably at least 4 inches (10.16 cm) thick with the head being 12 inches (30.48 cm) thick.

The trapped air bubbles support the platform and also act as shock absorbers to mitigate changes in surface conditions and reduce pitch and heave of the platform. This is illustrated in more detail in FIG. 4, which illustrates a typical wave curve 50 travelling beneath the platform. In FIG. 4, line 52 represents the average water line or bubble draft line in the modules, while line 54 represents the average water line in the surrounding water.

As illustrated in FIG. 4, for a simplified wave taking the form of a sine curve, when the crest of the wave is located beneath a module there will be an increase in surge force at that point in the structure. This will cause water to rise in that module, compressing the air in the trapped air chamber. The compressed air will escape via passageways 28 to adjacent chambers under lower pressure, as indicated by the arrows in FIG. 4. Bubble draft lines will therefore move up and down in the platform modules under wave action in a similar manner to pistons in the cylinders of an internal combustion engine.

With orifices of a suitable size linking each chamber to the adjacent chambers, a lower pressure chamber will receive air from any of its neighbors which are under higher pressure. This will partially charge the lower pressure chamber in anticipation of the surge that has charged the higher pressure chamber next to it, tending to dampen the force of the surge when it reaches the lower pressure chamber. Thus, the platform is pneumatically stabilized since vertical impact forces due to wave surges are muted by air compression and passage of trapped air between chambers.

The size of the orifices is critical for optimum results. If an orifice is too large, the desired compression in the chambers for optimum lift would not be reached. If an orifice is too small, the balancing effect due to air flow between the chambers will be lost. Additionally, the optimum orifice size will vary dependent on surrounding sea conditions, with the orifice size being larger if the sea is rougher. FIG. 5 schematically illustrates a suitable control circuit for controlling valve 30 and thus the orifice size dependent on sea conditions. Adjustment of valves 30 will be similar to adjustment of a racing car suspension system to meet variable track conditions.

This platform assembly will be suitable for constructing a very large floating platform suitable for supporting an offshore airport facility, for example, or extended living accommodations, a de-salinization plant, trash re-cycling facility or other large area installation for which there is insufficient space on land. It is suitable for platform areas of 360,000 square feet or greater. Although the platform has a rectangular periphery in the illustrated embodiment, clearly other platform shapes can be constructed by suitable arrangement of the modules to form the desired array shape.

The platform will be assembled partially on land and partially at sea for maximum economy. Clearly it would be impossible for practical purposes to assemble the entire platform on land. Thus, the modules will be secured together in manageable small bundles while on land, in the largest suitable size for launching and transit, and then towed to the platform site, where the bundles will be secured and linked together. The modules are preferably towable in an upright orientation, so that their draft or height must be compatible with the depth of channels linking on-shore construction sites to the off-shore platform site. Most major shipping channels are dredged to forty feet, so that the module example given above could be towed through such channels.

The modular design of this platform assembly lends itself to on-shore construction of relatively large segments, thereby reducing off-shore construction costs which are typically more expensive than on-shore costs. The individual modules are themselves of relatively simple construction, further reducing the expense of the platform.

Although the platform is constructed of identical small modules in the preferred embodiment for ease of construction, it may alternatively be constructed by securing a plurality of cylinders to the undersurface of a flat platform.

Figure 6:
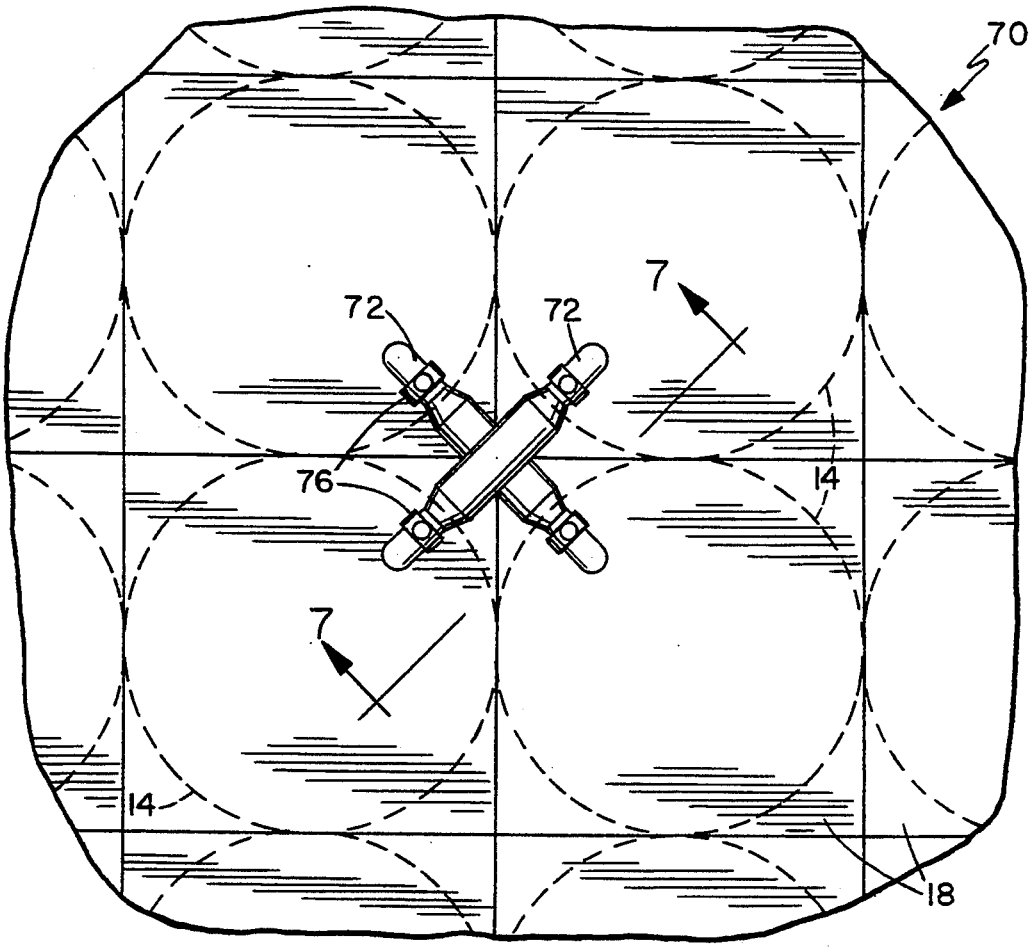
FIG. 6 is a top plan view of a portion of a platform with air driven power generating apparatus installed.
Figure 7:
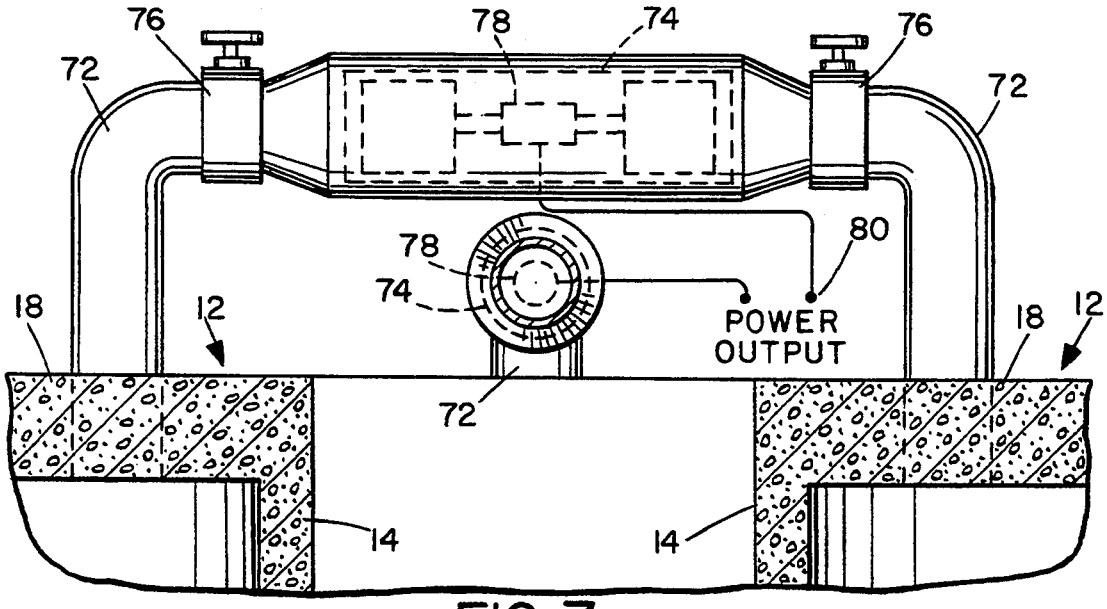
FIG. 7 is an enlarged sectional view taken on line 7—7 of FIG. 6.

FIGS. 6 and 7 illustrate part of a modified platform assembly 70. As in the previous embodiment, the platform is made up of modules 12 comprising hollow cylinders 14 and flat heads 18, and like reference numerals have been used for like parts as appropriate. However, instead of simple valved passageways linking all adjacent modules, some or all of the connections between modules are replaced by ducts or passageways 72 forming diagonal connections between diagonally-adjacent modules, as illustrated in FIG. 6. A conventional self-rectifying reversible air flow turbine generator 74 is mounted in the center of each duct 72, and valves 76 are located in the ducts on each side of turbine between the respective air chamber and the turbine. As in the previous embodiment, valves 76 are used to control the orifice size and also to shut down the connection if maintenance is needed for repair of the turbine. Each turbine has a power generator 78 which is connected to all the other power generators to provide an electrical power output 80 to a suitable storage and power transmission facility, which may be provided on the platform.

With this arrangement, the energy of each passing wave may be converted into compressed air flowing in the passageways 72 and readily converted into electrical energy by the generators 74.

This power would be relatively inexpensive to produce and would serve to offset the costs of constructing the platform.

The floating platform assembly described above is of relatively simple construction with identical modules being used to make up a platform of any desired size or shape simply by securing sufficient numbers of modules together both on and off shore. Since the modules are of relatively low draft, more construction can take place on shore and transportation is simplified. Individual modules are relatively small even for a massive floating platform, allowing them to be constructed on-shore in large numbers and stored until needed.

The constructed platform will be similar to a gigantic carpet supported on many pockets of air and thrown over the water surface. Unlike most previously proposed floating structures with widely spaced supports, each module of this structure will be directly sharing in the support of the entire platform in a monolithic fashion. This concept reduces the force differentials between support elements to a point where it can be assumed to act structurally as a monolithic entity, thereby significantly reducing the costs of the module and module connecting systems.

An additional advantage is the fact that impact loads due to wave action will be readily absorbed due to the compressible cushions of air extending across the entire platform area, and the interconnection between adjacent modules allowing even greater dampening of wave action. The platform assembly can also be readily constructed to include air flow turbine generators for converting wave forces to electrical energy, providing a source of revenue for offsetting the construction costs as well as a low cost source of energy which has less environmental hazards than traditional power plants.

Although a preferred embodiment of the invention has been described above by way of example only, it will be understood by those skilled in the field that modifications may be made to the disclosed embodiment without departing from the scope of the invention, which is defined by the appended claims.

I claim:

1. A floating platform assembly, comprising:

a plurality of hollow tubular members secured together side-by-side and with adjacent tubular members abutting one another to form an array of selected area;

each hollow tubular member having a flat head at one, upper end and being open at its opposite, lower end;

the flat heads of adjacent tubular members in the array being located adjacent one another to form a flat, continuous platform surface having an outer periphery which extends beyond the outer peripheries of the outermost tubular members in the array, with the tubular members comprising means for projecting downwardly into the water to receive water into their lower ends to trap air in trapped air chambers above the water level in each chamber;

the trapped air chambers comprising the sole means for supporting the platform surface above the water level, the open lower ends of the modules being spaced below all other parts of the assembly and comprising the lowermost portion of the assembly;

a plurality of connecting passageways connecting the trapped air chamber of each tubular member to at least two other trapped air chambers, the passageways comprises means for permitting air flow back and forth between the chambers; and the interconnected air chambers having no connection to any pressurized air source other than that within the trapped air chambers.

2. The assembly as claimed in claim 1, wherein the tubular members are cylinders and the head of each tubular member is square.

3. The assembly as claimed in claim 1, wherein the tubular members are identical in shape and dimensions.

4. The assembly as claimed in claim 1, wherein each tubular member has a plurality of outlet orifices spaced around its periphery and communicating with said trapped air chamber, the number of orifices being equal to the number of tubular members adjacent to said tubular member, each connecting passageway connecting a tubular member to an adjacent tubular member in the platform.

5. The assembly as claimed in claim 4, wherein each tubular member has a square head and each tubular member except for the tubing members located around the peripheral edge of the platform has four spaced orifices arranged at right angles to one another around the air chamber.

6. The assembly as claimed in claim 1, including an adjustable valve in each passageway for controlling the size of the orifice connecting each pair of air chambers.

7. The assembly as claimed in claim 6, including sensor means for sensing wave conditions in the sea surrounding the platform, and a controller responsive to the output of said sensor means for controlling the orifice size as a function of wave conditions.

8. The assembly as claimed in claim 1, wherein a plurality or passageways connect the air chamber in each tubular member to the trapped air chambers in a plurality of adjacent tubular members.

9. The assembly as claimed in claim 1, including a power generating means in at least some of the connecting passageways for converting the energy in air flowing through the passageways between trapped air chambers into electricity, each power generating means comprising a reversible turbine which rotates only in response to air flow between trapped air chambers in either direction through the respective passageway and a power generator for converting rotation of the turbine into electricity, each turbine being located in a respective one of the connecting passageways between adjacent tubular members in the platform.

10. The assembly as claimed in claim 9, including a pair of adjustable control valves in each connecting passageway containing a turbine, one valve being located on one side of the turbine and the other valve being located on the opposite side of the turbine.

11. A floating platform assembly, comprising:

a flat platform having an outer peripheral edge;

a plurality of hollow tubular members projecting downwardly from the platform at spaced intervals across the entire area of the platform, the tubular members being arranged side-by-side with substantially no space between adjacent tubular members, and having outer peripheries spaced inwardly from the outer peripheral edge of the platform, the tubular members being open at their lower ends to receive water into the members and trap air in air chambers above the water level in each tubular member;

the trapped air chambers comprising the sole means for supporting the platform above the water surface surrounding the assembly, the open lower ends of the tubular members comprising the lowermost portion of the assembly spaced below all other parts of the assembly; and a plurality of connecting passageways linking each air chamber to the air chambers in at least two other tubular members, the interconnected air chambers being completely isolated from any other pressurized gas source.

12. The assembly as claimed in claim 11, wherein each tubular member is of reinforced concrete material.

13. The assembly as claimed in claim 11, wherein each tubular member has a length of 40 feet.

14. The assembly as claimed in claim 11, wherein each tubular member has a height equal to twice the diameter of the tubular member.

15. The assembly as claimed in claim 11, wherein the platform is not laterally secured to any other body.

* * * * *

UNITED STATES PATENT AND TRADEMARK OFFICE

CERTIFICATE OF CORRECTION

PATENT NO. : 5,375,550

DATED : December 27, 1994

INVENTOR(S) : Donald A. Innis

It is certified that error appears in the above-indentified patent and that said Letters Patent is hereby corrected as shown below:

- COLUMN 6, CLAIM 1, LINE 45, REPLACE "COMPRISES" WITH --COMPRISING--;
- COLUMN 6, CLAIM 5, LINE 65, REPLACE "TUBING" WITH --TUBULAR--.

Signed and Sealed this

Second Day of May, 1995

Bruce Lehman

*Attest:*

BRUCE LEHMAN

*Attesting Officer*

*Commissioner of Patents and Trademarks*